US011746725B2

(12) United States Patent
Lineton et al.

(10) Patent No.: US 11,746,725 B2
(45) Date of Patent: Sep. 5, 2023

(54) STEEL PISTON HAVING OXIDATION AND EROSION PROTECTION

(71) Applicant: Tenneco Inc., Lake Forest, IL (US)

(72) Inventors: Warran Boyd Lineton, Chelsea, MI (US); Gregory Salenbien, Britton, MI (US); Michael Weinenger, Southfield, MI (US)

(73) Assignee: Tenneco Inc., Lake Forest, IL (US)

( * ) Notice: Subject to any disclaimer, the term of this patent is extended or adjusted under 35 U.S.C. 154(b) by 52 days.

(21) Appl. No.: 17/630,733

(22) PCT Filed: Jan. 17, 2020

(86) PCT No.: PCT/US2020/014048
§ 371 (c)(1),
(2) Date: Jan. 27, 2022

(87) PCT Pub. No.: WO2020/163058
PCT Pub. Date: Aug. 13, 2020

(65) Prior Publication Data

US 2022/0260033 A1 Aug. 18, 2022

Related U.S. Application Data

(60) Provisional application No. 62/846,916, filed on May 13, 2019, provisional application No. 62/846,307,
(Continued)

(51) Int. Cl.
*F02F 3/14* (2006.01)
*F02F 3/26* (2006.01)
(Continued)

(52) U.S. Cl.
CPC ..... *F02F 3/14* (2013.01); *F02F 3/22* (2013.01); *F02F 3/26* (2013.01); *F02F 2003/0061* (2013.01)

(58) Field of Classification Search
CPC ..... F02F 3/0084; F02F 3/14
See application file for complete search history.

(56) References Cited

U.S. PATENT DOCUMENTS

2003/0196547 A1 10/2003 Bischofberger et al.
2007/0000468 A1* 1/2007 Azevedo ..... F02F 3/0084 92/209
(Continued)

FOREIGN PATENT DOCUMENTS

CN 107110063 A 8/2017
DE 10029810 A1 12/2001
(Continued)

OTHER PUBLICATIONS

International Search Report and Written Opinion dated Jun. 24, 2020 for International Application No. PCT/US2020/014048, 9 pages.

*Primary Examiner* — Long T Tran
(74) *Attorney, Agent, or Firm* — Robert L. Stearns; Dickinson Wright PLLC

(57) ABSTRACT

A piston for an internal combustion engine which is coated for enhanced oxidation protection and/or erosion protection is provided. The piston includes a body formed of an iron-based material. The iron-based material is coated with a superalloy and manganese phosphate. The superalloy is preferably NiCrAlY, NiCrAl, NiCr, CoCrAly, and/or CoNiCrAlY. The manganese phosphate can be disposed on the superalloy, but not between the superalloy and the iron-based material. The superalloy preferably has a thickness of 0.1 to 2.0 mm, a porosity of 1% to less than 5%, and a surface roughness of less than 5 microns Ra. Another component for an internal combustion engine which is coated with the superalloy and the manganese phosphate is also provided.

23 Claims, 3 Drawing Sheets

Related U.S. Application Data filed on May 10, 2019, provisional application No. 62/796,698, filed on Jan. 25, 2019, provisional application No. 62/794,223, filed on Jan. 18, 2019.

(51) Int. Cl.
*F02F 3/22* (2006.01)
*F02F 3/00* (2006.01)

(56) References Cited

U.S. PATENT DOCUMENTS

| | | | | |
|---|---|---|---|---|
| 2012/0037112 | A1 | 2/2012 | Muscas | |
| 2016/0059366 | A1* | 3/2016 | Flowers | B23P 15/10 92/172 |
| 2016/0123274 | A1 | 5/2016 | Miller et al. | |
| 2017/0314503 | A1 | 11/2017 | Rasmussen | |
| 2018/0128166 | A1* | 5/2018 | Lineton | C23C 28/36 |
| 2018/0216524 | A1* | 8/2018 | Lineton | F01L 3/04 |
| 2020/0080587 | A1* | 3/2020 | Campbell | F16J 1/08 |
| 2020/0123998 | A1* | 4/2020 | Lineton | C23C 4/134 |

FOREIGN PATENT DOCUMENTS

| | | | |
|---|---|---|---|
| DE | 102007006948 | A1 | 12/2007 |
| DE | 102009025035 | A1 | 5/2010 |
| EP | 1898065 | A1 | 3/2008 |
| JP | 2004503708 | A | 2/2004 |
| JP | 2018145957 | A | 9/2018 |

* cited by examiner

STEEL PISTON HAVING OXIDATION AND EROSION PROTECTION

CROSS-REFERENCE TO RELATED APPLICATIONS

This U.S. national phase application claims priority to international (PCT) patent application no. PCT/US2020/014048, filed Jan. 17, 2020, which claims priority to U.S. provisional patent application nos. 62/794,223, filed Jan. 18, 2019, 62/796,698, filed Jan. 25, 2019, 62/846,307, filed May 10, 2019, and 62/846,916, filed May 13, 2019, the entire contents of which are incorporated herein by reference.

BACKGROUND

Technical Field

This invention relates to vehicle components exposed to high temperatures, for example pistons of internal combustion engines and exhaust manifolds, and to measures used to protect the components from oxidation and erosion in an operating environment over the life of the component.

Related Art

The performance demands on vehicle components exposed to high temperatures, such as pistons, are increasing. Consequently, crowns of such pistons are expected to be exposed to increasing temperatures during use. For example, a piston made of 4140 or microalloy steel may have an upper temperature design limit of 520° C. If exposed to operating temperatures above that limit, problems with oxidation and erosion that could be detrimental to performance and longevity of the piston could occur. One possible solution is to switch to a different steel alloy, but considerations of high cost, decreased conductivity and larger but still restricted design temperature limits make such options unfit for use in projected applications where the operating temperature could reach or even exceed 800° C.

SUMMARY

One aspect of the invention provides a piston which has enhanced oxidation protection and/or erosion protection during use of the piston in an internal combustion engine. The piston comprises a body formed of an iron-based material, a superalloy disposed on the body, and manganese phosphate disposed on at least one of the body and the superalloy.

A second embodiment also provides a piston which has enhanced oxidation protection and/or erosion protection during use of the piston in an internal combustion engine. The piston comprises a body formed of an iron-based material, and a superalloy disposed on the body. The superalloy is selected from the group consisting of NiCrAlY, NiCrAl, NiCr, CoCrAly, and CoNiCrAlY. The superalloy has a thickness of 0.1 to 2.0 mm, a porosity of 1% to less than 5%, and a surface roughness of less than 5 microns Ra.

Another aspect of the invention provides a component for an internal combustion engine which has enhanced oxidation protection and/or erosion protection during use of the piston in an internal combustion engine. The component comprises a body formed of an iron-based material, a superalloy disposed on the body, and manganese phosphate disposed on at least one of the body and the superalloy.

BRIEF DESCRIPTION OF THE DRAWINGS

These and other features and advantages of the invention will be more fully appreciated when considered in connection with the specification below and with the following drawings, in which.

DETAILED DESCRIPTION OF EXAMPLE EMBODIMENTS

One aspect of the invention provides a vehicle component exposed to high temperatures during operation, for example a piston 10 or an exhaust manifold. A body 12 of the piston 10, or other component, is coated with a superalloy 14 and, in some embodiments, with manganese phosphate (MnP) 16 for enhanced oxidation protection and/or erosion protection.

Figure 1:
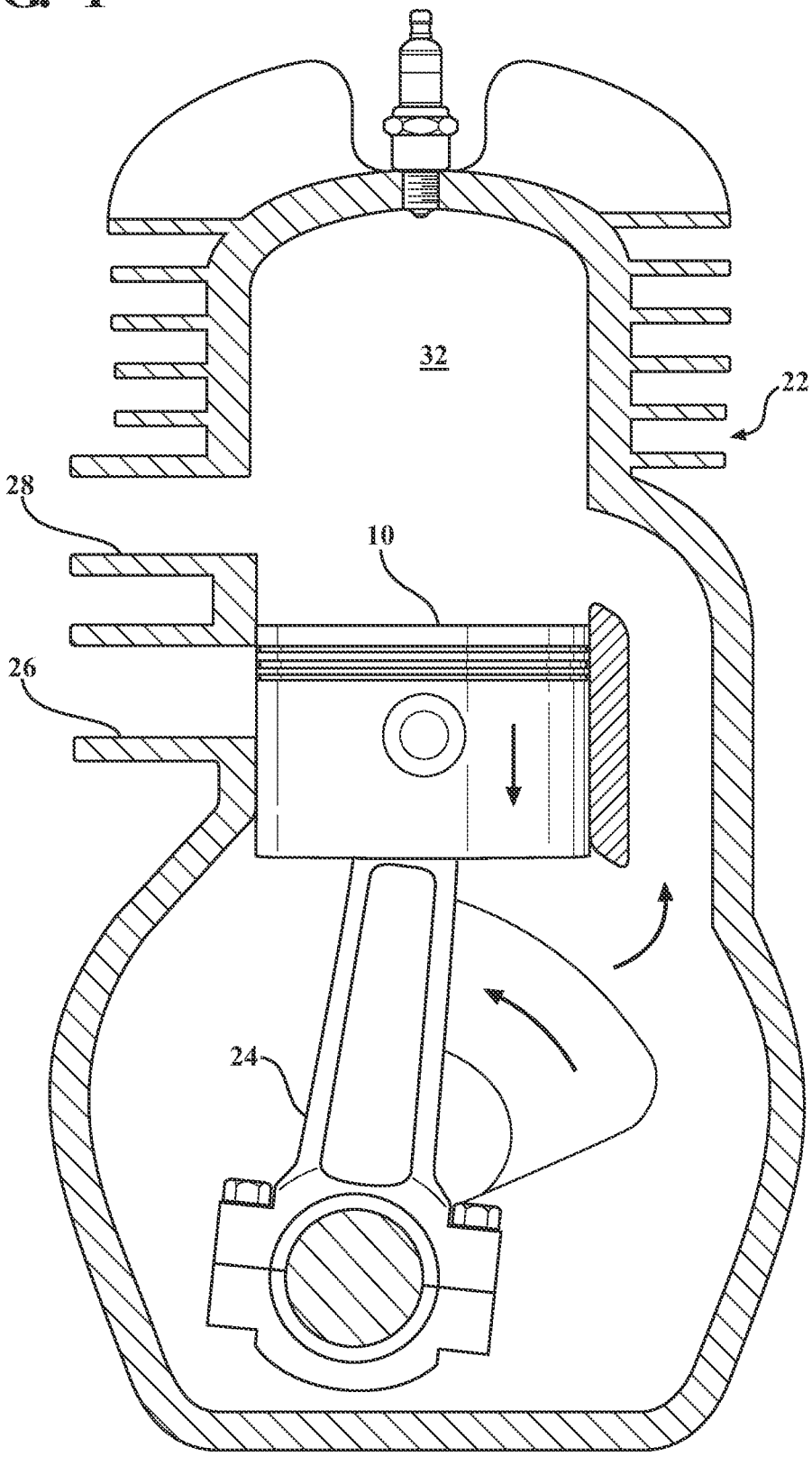
FIG. 1 illustrates a piston in a two-stroke internal combustion engine according to an example embodiment.
Figure 2:
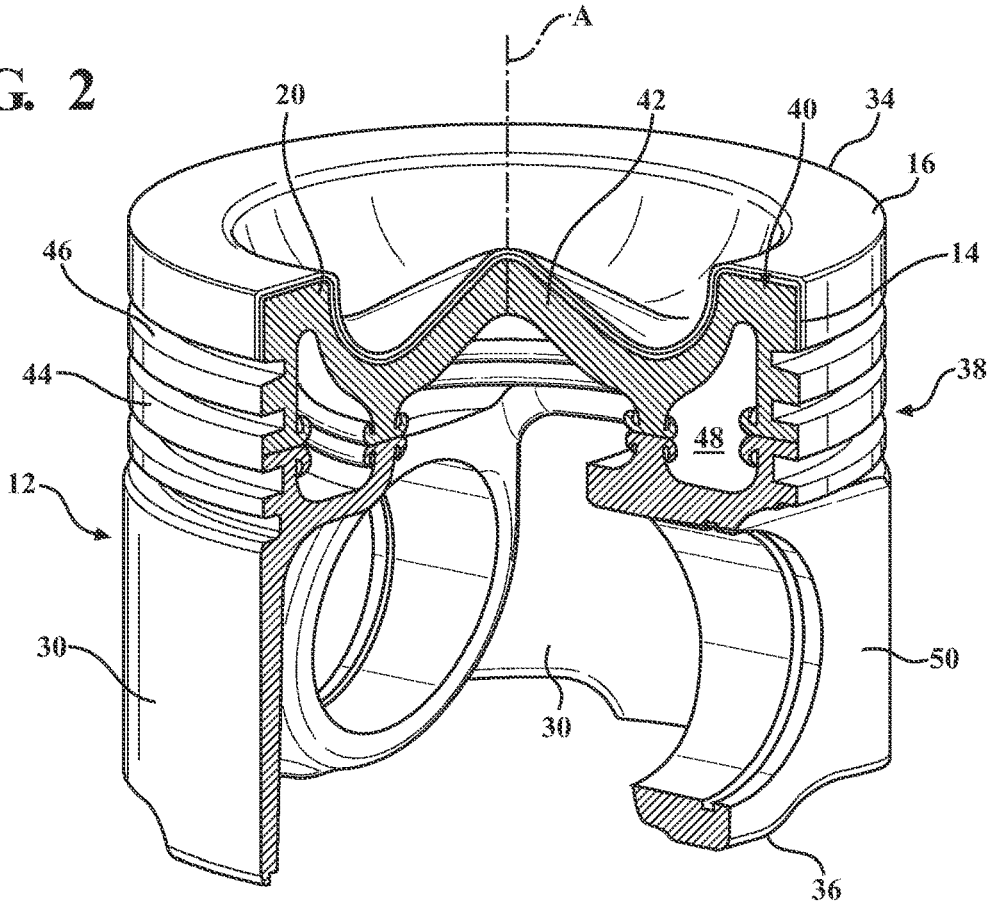
FIG. 2 is a cross-sectional perspective view of a piston according to an example embodiment.
Figure 3:
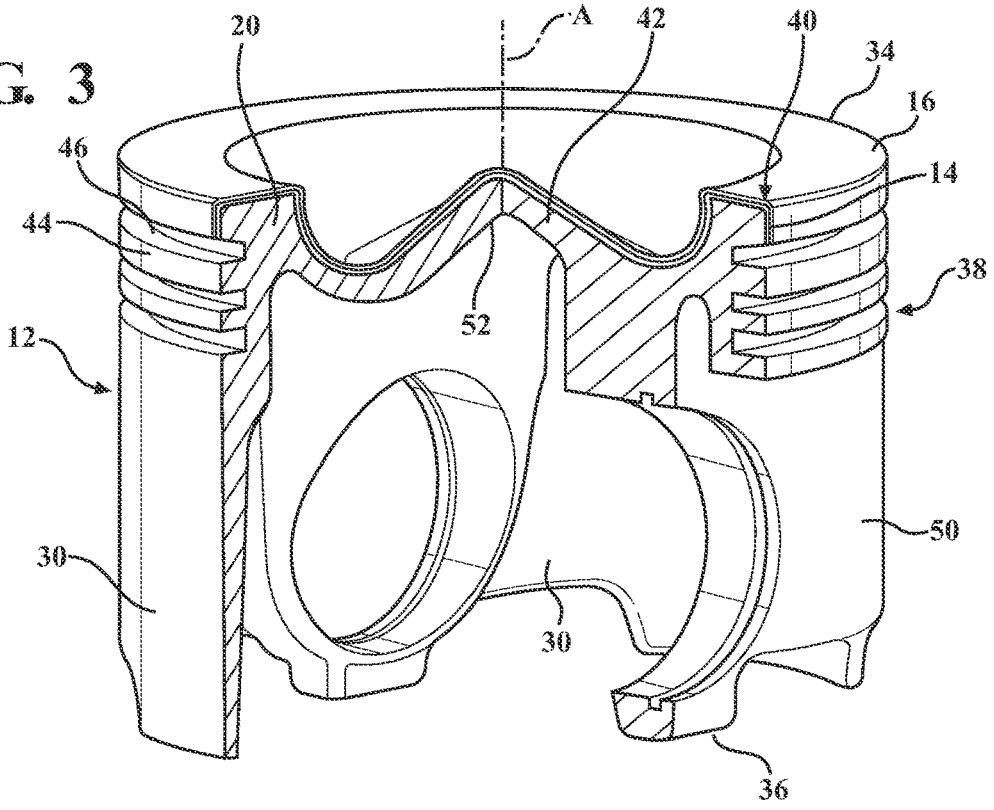
FIG. 3 is a cross-sectional perspective view of a piston according to another example embodiment.

The superalloy 14 and MnP 16 can be applied to various vehicle components, for example pistons and exhaust manifolds of various different designs. FIGS. 1-3 are examples of the types of pistons 10 which can be coated. The present description will refer to the piston 10, as an example, but other engine components could be coated with the superalloy 14 and MnP 16. Typically, the body 12 of the piston 10 is formed of 4140 or microalloy steel. The body 12 could alternatively be formed of cast iron or another metal material.

The upper temperature design limit of an uncoated piston body 12 formed of the 4140 steel may be 520° C., and specific regions of the body 12, for example a bowl rim 20, can be damaged if the body 12 is exposed to temperatures exceeding 520° C. Damage on the bowl regions may be detrimental to the integrity and longevity of the piston. It is expected that other steel alloy piston bodies subjected to extreme operating temperatures (exceeding their upper design limit) would experience similar damage due to oxidation and/or erosion, and thus the above is meant to be representative to generally all steel piston bodies of present time. However, if the superalloy 14 is applied to the steel body 12, then the piston can withstand exposure to operating temperatures of an internal combustion engine, and specifically a Diesel engine, approaching and exceeding 800° C.

In one example embodiment, the piston 10 is designed for a two-stroke engine 22, as shown in FIG. 1. The two-stroke engine completes a power cycle with two strokes, e.g. up and down movements, of the piston 10 during only one crankshaft revolution. Typically, the two-stroke engine includes a crankcase 24 for gas exchange, an intake port 26, an exhaust port 28, and the piston 10. During operation of the two-stroke engine, the piston 10 can act not only as a piston, but also as a compressor, an intake valve, and an exhaust valve. Because the two-stroke combustion engine has the inlet and exhaust ports, rather than valves, portions of a lower part of the piston 10, for example skirt sections 30, of the piston 10 are used to seal the combustion chamber and are used as intake and exhaust valves when the piston 10 reciprocates in a chamber 32 of the engine. The two-stroke piston 10 of this example embodiment is described in detail in co-pending U.S. patent application Ser. No. 16/287,714, which is incorporated herein by reference.

Another example of the coated piston 10 is shown in FIG. 2. The example piston 10 is designed for use in a heavy duty diesel engine. In the example embodiment, the piston 10 includes the body 12 formed of the metal material, specifically steel. The steel used to form the body 12 can be is AISI 4140 grade or a microalloy 38MnSiVS5, for example. The body 12 extends around a center axis A and longitudinally along the center axis from an upper end 34 to a lower end 36. The body 12 also includes a crown 38 extending circumferentially about the center axis from the upper end toward the lower end. In the embodiment of FIG. 2, the crown 38 is joined to the remainder of the body 12, in this case by welding.

The crown 38 of the piston 10 defines a combustion surface 40 at the upper end which is directly exposed to hot gasses, and thus high temperatures and pressures, during use of the piston 10 in the internal combustion engine. In the example embodiment, the combustion surface 41) includes a combustion bowl 42 extending from the planar outer bowl rim 20 and the combustion surface 40 includes an apex at the center axis. The crown 38 of the piston 10 also includes a ring belt defining lands 44 and at least one ring groove 46 located at an outer diameter surface and extending circumferentially about the center axis for receiving at least one ring (not shown) Typically the piston 10 includes two or three ring grooves 46. The ring lands 44 are disposed adjacent each ring groove and space the ring grooves 46 from one another and from the combustion surface 40.

In the example of FIG. 2, the piston 10 includes a cooling gallery 48 extending circumferentially around the center axis between the crown 38 and the remainder of the body 12. The cooling gallery 48 can contain a cooling fluid to dissipate heat away from the hot crown 38 during use of the piston 10 in the internal combustion engine. In addition, cooling fluid or oil can be sprayed into the cooling gallery 48 or along an interior surface of the crown 38 to reduce the temperature of the crown 38 during use in the internal combustion engine.

As shown in FIG. 2, the body 12 further includes a pair of pin bosses 50 spaced from one another about the center axis and depending from the crown 38. Each pin boss defines a pin bore for receiving a wrist pin which can be used to connect the piston 10 to a connecting rod. The body 12 also includes the pair of skirt sections 30 spacing the pin bosses 50 from one another about the center axis and depending from the crown 38.

According to another example embodiment which is shown in FIG. 3, the piston 10 is a galleryless piston 10. The galleryless piston 10 includes the crown 38 presenting the combustion surface 40 which is directly exposed to combustion gasses of a combustion chamber contained within a cylinder bore of the internal combustion engine. In the example embodiment, the combustion surface 40 includes the apex at the center axis. The ring grooves 46 and ring lands 44 depend from the combustion surface 40 and extend circumferentially along the outer diameter of the piston 10. The galleryless piston 10 also includes the pin bosses 50 spaced from one another about the center axis by the skirt sections 30.

An undercrown surface 52 of the piston 10 of FIG. 3 is formed on an underside of the crown 38, opposite the combustion surface 40 and radially inwardly of the ring grooves 46. The undercrown surface 52 is the surface that is visible, excluding any pin bores when observing the piston 10 straight on from the bottom. The undercrown surface 52 is openly exposed, as viewed from an underside of the piston 10, and it is not bounded by a sealed or enclosed cooling gallery.

Figure 4:
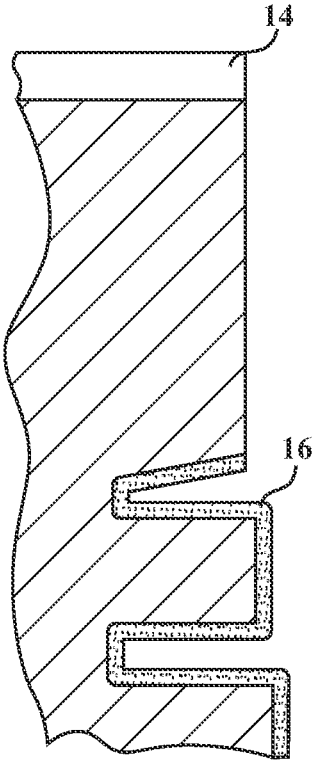
FIG. 4 is a cross-sectional view of a portion of a piston coated with a superalloy and manganese phosphate according to an example embodiment.
Figure 5A:
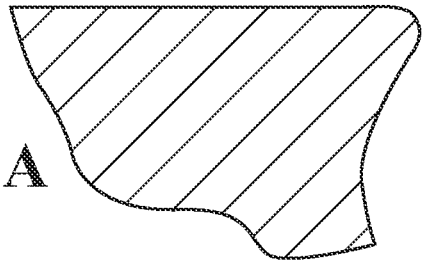
FIGS. 5*a*-5*e* are fragmentary schematic views of steps in a process of making a piston according to an example embodiment.

As stated above, the superalloy 14, or a combination of the superalloy 14 and MnP 16 are applied to the body 12 of the piston 10. Typically, the superalloy 14 is applied prior to the MnP 16. FIG. 4 is an enlarged view of a portion of the piston 10 according to an example embodiment. FIG. 4 is a cross-sectional view of a portion of the piston 10 including the superalloy 14 on the combustion bowl 42 and bowl rim 20, no coating (bare steel exposed) on the top land, and the MnP 16 below the top land. FIGS. 5*a*-5*e* schematically illustrate a method of applying the superalloy 14 to the body 12 of the piston 10 according to an example embodiment. FIG. 5*a* illustrates the steel crown 38 in its initial rough formed state. This could be as-forged or rough machined. The combustion surface 40 of the crown 38 is illustrated as being rough in appearance and represents the as-forged or rough-machined condition. This combustion surface 40 is exposed to the extreme heat and pressure of combustion of an engine cylinder when in use, along with exposure to the fuel/air mixture introduced into and combusted within the cylinder in close proximity to or immediately against all or targeted portions of the combustion surface 40.

Figure 5B:
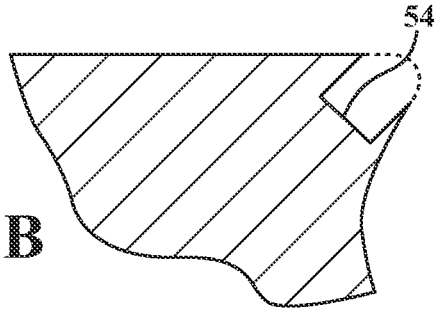

According to some example embodiments, the superalloy 14 is disposed in a recess or pocket 54 in the body 12 of the piston 10, although the pocket 54 is not required. FIG. 5*b* shows the recess or pocket 54 formed in the combustion surface 40. There can be one or several of such pockets 54 formed in the combustion surface 40. Such pockets 54 are preferably machined in the forged crown 38 or machined in during the initial pre-machining of the crown 38. The pockets 54 may take on a number of different shapes and sizes depending upon the particular application. The geometry of the pockets 54 can vary and what is shown is exemplary of just one approach. The pocket 54 can have straight side walls which may be set at 90 degrees to the floor of the pocket 54. There may be radius at the transition between the side walls and the floor. The side walls may be slightly canted inward (e.g., 1-2 degrees) to provide a reentrant geometry to the pocket 54 to further enhance the mechanical separation force of the bonded superalloy 14 in the pocket 54. The pocket 54 may take the form of a chamfer, as in the case of the edge of the bowl rim 20, wherein the original profile is machined away to a chamfer, grit blasted and then built back up with the application of the superalloy 14.

Figure 5C:
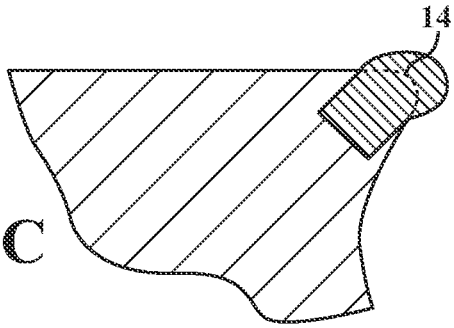

FIG. 5*c* illustrates an example wherein the pocket 54 is filled, and preferably overfilled, with the superalloy 14. Prior to filling, the pocket 54 is suitably cleaned to receive and bond directly with the superalloy 14 introduced to the pocket 54. The superalloy 14 is preferably disposed directly on the steel material of the body 12 of the piston 10, without a coating or any other material located between the body 12 and the superalloy 14. Proper cleaning can involve such steps as grit blasting, washing with liquid solvent(s) and drying with compressed air to present a clean surface of the pocket 54 free of contamination and ready to receive and bond with the superalloy 14. The grit blasting imparts a roughened surface to the pocket 54 that helps the superalloy 14 achieve a strong mechanical bond with the steel of the piston crown 38. After cleaning, but prior to the introduction of the superalloy 14, the combustion surface 40 may be masked to cover all but the exposed pocket 54. The mask may take various forms and could be a reusable metal mask, such as copper, or a silicone-based tape which would cover all but the region to receive the superalloy 14. The crown 38 may be supported in a fixture (not shown) and the fixture may be rotated during application of the superalloy 14, such as at 100-700 rpm. The application of the superalloy 14 is preferably a thermal spray process. In this example embodiment, the thermal spray process introduces the superalloy 14 to the pocket 54 in a molten state where it initially bonds with the steel bottom and side walls of the pocket 54. The molten superalloy 14 is delivered at a controlled velocity toward the pocket 54 in the form of molten droplets which flatten out and solidify and bond on impact as pancake-like splats of the material. This process continues as more superalloy 14 is added, causing the superalloy 14 to build up on itself in the pocket 54 to the point where the volume of the applied superalloy 14 exceeds the volume of the pocket 54 and the pocket 54 becomes over-filled with the superalloy 14, as illustrated in FIG. 5*b*. In FIG. 5*b*, the upper region of the superalloy 14 is shown projecting out of the top of the pocket 54 and above the combustion surface 40 of the crown 38. The thermal process for introducing the superalloy 14 may be one of plasma spray, HVOF, wire arc or laser cladding. The form of the superalloy 14 used in the thermal application process is preferably wire or powder form. The superalloy 14 that first enters and then builds in the pocket 54 is in a molten state (molten droplets of the superalloy 14) and is not pre-applied in a non-molten state and thereafter fused, as some other application techniques. The applied superalloy 14 does not alloy with the steel material of the piston crown 38. Thus, the superalloy 14 does not become diluted and maintains the properties that are characteristic of the selected material. The adhesion or bond between the superalloy 14 and the steel of the body 12 is a mechanical one and not principally metallurgical. The molten nature of the applied superalloy 14 and the grit-blasted surface cooperate to provide very high levels of bond strength to the final superalloy 14 exceeding 6,500 psi.

The superalloy 14 is disposed directly on the steel material of the body 12 and may be applied to an initial thickness (from the floor to the surface of the as-deposited superalloy 14) of 0.1 to 2.0 mm, although a greater thickness may be applied if needed. According to example embodiments, the thickness ranges from 200 to 400 microns. The porosity of the as-applied superalloy 14 is less than 5% of the total volume of the superalloy 14, preferably 1-3% of the total volume of the superalloy 14, and most preferably 1-2% of the total volume of the superalloy 14. Candidate superalloys 14 include at least one of NiCrAlY, NiCrAl, NiCr, CoCrAly, and CoNiCrAlY.

The areas of the steel piston crown 38 where the superalloy 14 is provided are principally those regions that are deemed most vulnerable to attack (oxidation and/or erosion) when subjected to the extreme operating temperatures in use, for example, temperatures reaching and even exceeding 800° C. as mentioned. However, the superalloy 14 could be applied to other areas.

The area shown in FIGS. 5*a*-5*e* includes a portion of the piston crown 38 vulnerable to attack, specifically the edge of the bowl rim 20. This area is particularly vulnerable because it is high in the piston crown 38 and very near to the plume of mixed fuel/air that is delivered into and ignites within the combustion chamber. The edge of the bowl rim 20 represents an inwardly projecting edge which has a large surface area backed by a relatively small amount of steel material, as compared to other regions of the piston crown 38 and thus the heat of combustion is not able to be dissipated into the mass of the piston crown 38 and remaining piston body 12 quickly enough to save the edge of the bowl rim 20 from attack from the extreme high temperature, high pressure, corrosive environment of a Diesel engine operating at temperatures at or above 800° C. Prolonged exposure can cause this edge region to oxidize and even erode.

According to an aspect of the invention, some or all of the original edge of the steel bowl rim 20 schematically illustrated in FIG. 5*a* would be first cut back to form the pocket 54, as schematically illustrated in FIG. 5*b*, for receiving the superalloy 14. Following the steps outlined above, the superalloy 14 would be introduced into the pocket 54 where it bonds to the steel walls of the pocket 54 and is built up to the point where it projects out of the pocket 54 as schematically illustrated in FIG. 5*c*.

Figure 5D:
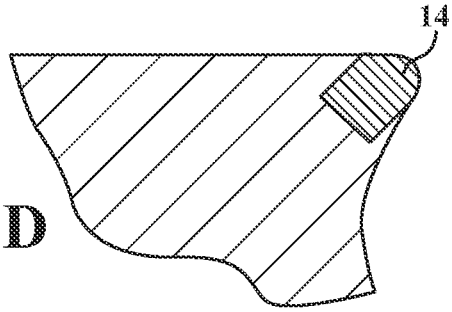

After the superalloy 14 is applied, the piston crown 38 and piston 10 can undergo normal machining (FIG. 5*d*), welding, tempering, cleaning, coating operations that would be used with a conventional steel piston of this type. FIG. 5*d* illustrates the piston crown 38 having been machined with excess of the built-up superalloy 14 machined away along with some of the steel crown 38 to present a machined surface.

A further advantage of the superalloy 14 in connection with the manufacture of the piston 10 is that it can be applied early in the manufacturing sequence. The piston crown 38 can be forged and rough machined and then the superalloy 14 can be added (steps shown in FIGS. 5*a* and 5*b*). All subsequent machining can be carried out as normal. Even welding and heat treating operations can be performed without impairing the integrity of the superalloy 14 since it is not adversely affected by temperatures seen in welding. For example, the piston crown 38 may be welded (e.g., friction welded) to the lower part of the piston 10 as part of the manufacturing step of making the piston 10. Any heat seen from friction welding is well below the temperature (about 1000° C.) that would affect the superalloy 14. The same holds true for subsequent manufacturing steps involving application of heat, including back tempering following friction welding and curing oven temperatures for certain additional coating applications (e.g., graphite, manganese phosphate, etc.). The superalloy 14 is also advantageous in that it is amendable to machining and coating operations in the same way as a conventional piston, so otherwise standard processes normally used for making steel pistons can still be used and without modification.

One variation on the superalloy 14 reinforced steel piston crown 38 is that the entire upper surface of the piston crown 38 can be cut back and then rebuilt with the superalloy 14, which is then machined to achieve the desired compression height and geometry, etc.

In example embodiments, the superalloy 14 is applied to the body 12 in the form of a coating. For example, the superalloy 14 can be applied to the entire combustion surface 40 of the piston 10, including the bowl rim 20 and the combustion bowl 42. Alternatively, the superalloy 14 could be applied to only portions of the combustion surface 40, for example only to the bowl rim 20 or only to portions of the bowl rim 20 spaced from one another circumferentially.

According to an example embodiment, the superalloy 14 is NiCrAlY, which includes 67 wt. % nickel, 22 wt. % chromium, 1 wt. % yttrium, and 10 wt. % aluminum, based on the total weight of the superalloy 14. In this case, the superalloy 14 is applied by plasma spraying to a thickness of about 300 microns or about 200 microns.

In the example embodiment wherein the superalloy 14 is NiCrAlY, the superalloy 14 has a porosity of less than 3%.

A smoothing process can be applied to the superalloy 14 to knock off peaks in the superalloy 14 and reduce the surface roughness to less than 5 microns Ra, preferably less than 3 micros Ra, and most preferably 1 micron Ra, or less. The roughness, with appropriate polishing of the superalloy 14 can reach Ra<1 micron because of the low porosity. In this case, 10 to 50 microns of superalloy 14 is removed during the smoothing process. According to one embodiment, the piston 10 is located in abrasive media that is vibrated at a high frequency to knock off the peaks of the superalloy 14.

Figure 5E:
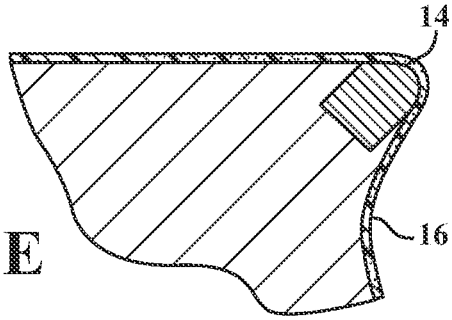

According to certain embodiments, the piston 10 also includes the MnP 16 applied to directly to the body 12 and/or to the superalloy 14. The MnP 16 can be applied over the superalloy 14 and/or around the superalloy 14, but not beneath the superalloy 14 because the superalloy 14 is disposed directly on the bare steel material of the body 12. The MnP 16 should not be located beneath the superalloy 14, as it could prevent the superalloy 14 from adhering. FIGS. 2 and 3 show layer of the MnP 16 disposed on a layer of the superalloy 14. FIG. 5*e* is another example of a layer of the MnP 16 disposed over a layer of the superalloy 14.

If the MnP 16 is applied before the superalloy 14, the surfaces of the body 12 to which the superalloy 14 will be applied are masked while the MnP 16 is applied. The superalloy 14 is then applied to the surfaces of the body 12, for example the bowl and/or the bowl rim, which are not coated with the MnP 16, after the MnP 16 is applied.

According to one embodiment, the superalloy 14 is applied to the entire combustion bowl 42, bowl rim 20, and edge of the bowl rim 20, but not a top land of the ring belt. The MnP 16 is located on the ring belt, including on all of the lands 44 and in the ring grooves 46. The MnP 16 can also be located on other surfaces of the body 12 where the superalloy 14 is not present.

However, even with the masking, it could be difficult to prevent any MnP 16 from being applied to the bowl rim 20 of the body 12 when the MnP 16 is applied. Masking of the two-stroke piston 10 can be difficult due to an injection slot. Thus, according to one embodiment, at least a portion of the top land of the ring belt, for example the portion adjacent the bowl rim 20 and on opposite sides of the slot, is masked in addition to the combustion bowl 42 and bowl rim 20, during the process of applying the MnP 16. The superalloy 14 is then applied to the bowl rim 20 and the combustion bowl 42, and no coating or material is applied to the top land or portion of the ring belt which is masked during the step of applying the MnP 16. The MnP 16 can be located on the surfaces below the uncoated portions, for example all surfaces below the top land.

According to another embodiment, the manganese phosphate 16 is applied to the entire piston body 12 or portions of the body 12 after the superalloy 14 is applied. In this case, the manganese phosphate 16 covers at least a portion of the superalloy 14. The manganese phosphate 16 is not expected to impair the performance of the superalloy 14 when disposed over the superalloy 14. Thus, no masking is required when applying the manganese phosphate 16 and no masking is required when applying the superalloy 14. However, the superalloy 14 could optionally be masked while applying the manganese phosphate 16.

According to one embodiment, when the layer of superalloy 14 is applied to the body 12, edges of the superalloy 14 layer are masked to prevent the MnP 16 from undercutting the superalloy 14 layer. Alternatively, since the undercut, if it is occurs, is typically <50 microns, the layer edge could be blended after the MnP 16 is applied. Blending can be done by abrasive finishing, for example stoning or filing.

The resultant piston 10 can have the same overall visual and mechanical appearance and performance as a traditional all-steel piston of the same design, except the superalloy 14 and MnP 16 now enable such a piston to operate in an engine whose operating temperature is at or above 800° C. without causing oxidation and/or erosion to the bowl edge region (or any other region where the superalloy 14 and MnP 16 have been applied in similar manner as described herein. The superalloy 14 is robust up to temperatures of about 1000° C. which is well above the 800° C.+ operating temperature expected of engines.'

Many modifications and variations of the present invention are possible in light of the above teachings and may be practiced otherwise than as specifically described while within the scope of the claims. It is also contemplated that all features of all claims and of all embodiments can be combined with each other, so long as such combinations would not contradict one another.

The invention claimed is:

1. A piston, comprising:

a body formed of an iron-based material, a superalloy disposed on said body, and manganese phosphate disposed on at least one of said body and said superalloy.

2. The piston of claim 1, wherein said superalloy is selected from the group consisting of NiCrAlY, NiCrAl, NiCr, CoCrAly, and CoNiCrAlY.

3. The piston of claim 2, wherein said superalloy is NiCrAlY.

4. The piston of claim 1, wherein said superalloy is in the form of a layer having a thickness of 200 to 400 microns.

5. The piston of claim 1, wherein said manganese phosphate is not disposed between said superalloy and said iron-based material of said body.

6. The piston of claim 1, wherein said body includes a crown at an upper end of said body, said crown includes a combustion surface at said upper end, said combustion surface presents a planar outer rim extending circumferentially along an outer diameter of said body, said combustion surface presents a combustion bowl extending inwardly from an inner edge of said outer rim, and said superalloy is disposed along said inner edge of said outer rim.

7. The piston of claim 1, wherein said body includes a crown at an upper end of said body, said crown includes a combustion surface at said upper end, said crown includes a ring belt extending circumferentially about a center axis and presenting an outer diameter surface of said body, said ring belt includes at least one ring groove for receiving at least one ring, said crown includes a recess in at least one of said combustion surface and said ring belt, and said superalloy is disposed in said recess.

8. The piston of claim 7, wherein said combustion surface presents a combustion bowl at said center axis, and said recess is spaced from said combustion bowl.

9. The piston of claim 1, wherein said superalloy is disposed on an upper end of said body, and said superalloy is in the form of a coating presenting an uppermost surface of said piston.

10. The piston of claim 8, wherein said coating consists of said superalloy.

11. The piston of claim 1, wherein said body includes a crown at an upper end of said body, said crown includes a combustion surface at said upper end, said crown includes a ring belt extending circumferentially about a center axis and presenting an outer diameter surface of said body, said ring belt includes at least one ring groove for receiving at least one ring, said superalloy is disposed on all of said combustion surface, said superalloy is not disposed on said ring belt, said manganese phosphate is disposed on said ring belt, said manganese phosphate is not disposed on said combustion surface, and said manganese phosphate is not disposed on said superalloy.

12. The piston of claim 11, wherein said manganese phosphate is not disposed on a top land of said ring belt.

13. The piston of claim 12, wherein said top land of said ring belt is uncoated.

14. The piston of claim 1, wherein said manganese phosphate is disposed on said superalloy and disposed on all surfaces of said body which are not coated with said superalloy.

15. The piston of claim 1, wherein a layer of said superalloy is disposed on said body, said layer presents edges, said manganese phosphate is disposed on said superalloy and disposed on at least one portion of said body not coated with said superalloy, and said manganese phosphate is spaced from said edges of said superalloy layer.

16. The piston of claim 1, wherein said body is formed of a steel material or cast iron, said body extends around a center axis and longitudinally along said center axis from an upper end to a lower end, said body includes a crown extending circumferentially about said center axis from said upper end toward said lower end, said crown includes combustion surface at said upper end, said crown includes a ring belt extending circumferentially about a center axis and presenting an outer diameter surface of said body, said ring belt includes at least one ring groove for receiving at least one ring, said body includes a pair of pin bosses spaced from one another and depending from said crown, each of said pin bosses defines a pin bore for receiving a wrist pin, said body includes a pair of skirt sections spacing said pin bosses from one another and depending from said crown, said superalloy is disposed directly on said iron-based material of said body, said superalloy is selected from the group consisting of NiCrAlY, NiCrAl, NiCr, CoCrAly, and CoNiCrAlY, said superalloy has a thickness of 0.1 to 2.0 mm, said superalloy has a porosity of 1% to less than 5%, said superalloy has a surface roughness of less than 5 microns Ra, and said manganese phosphate is not disposed between said superalloy and said iron-based material of said body.

17. The piston of claim 16, wherein said body includes a cooling gallery extending circumferentially around said center axis.

18. The piston of claim 16, wherein said body includes an undercrown surface facing opposite said combustion surface, and said undercrown surface is openly exposed and not bounded by a sealed or enclosed cooling gallery.

19. The piston of claim 1, wherein said superalloy is in the form of a superalloy layer, said superalloy layer consists of said superalloy, and said superalloy layer and/or said manganese phosphate forms an uppermost surface of said piston.

20. A piston, comprising:

a body formed of an iron-based material, a superalloy layer disposed directly on said body, said superalloy layer consisting of a superalloy, said superalloy being selected from the group consisting of NiCrAlY, NiCrAl, NiCr, CoCrAly, and CoNiCrAlY, said superalloy having a thickness of 0.1 to 2.0 mm, said superalloy having a porosity of 1% to less than 5%, said superalloy having a surface roughness of less than 5 microns Ra, optionally manganese phosphate disposed on at least one of said body and said superalloy layer, and at least one of said superalloy layer and said optional manganese phosphate forming an uppermost surface of said piston.

21. The piston of claim 20, wherein said superalloy is NiCrAlY.

22. A component for an internal combustion engine, comprising:

a body formed of an iron-based material, a superalloy disposed on said body, and manganese phosphate disposed on at least one of said body and said superalloy.

23. The component of claim 22, wherein said superalloy is selected from the group consisting of NiCrAlY, NiCrAl, NiCr, CoCrAly, and CoNiCrAlY.

* * * * *